United States Patent [19]

Vornberger et al.

[11] Patent Number: 4,660,242

[45] Date of Patent: Apr. 28, 1987

[54] ACTIVATOR

[75] Inventors: Walter Vornberger, Tewksbury, Mass.; Karl F. Vornberger, Amherst, N.H.

[73] Assignee: International Shoe Machine Corporation, Nashua, N.H.

[21] Appl. No.: 842,967

[22] Filed: Mar. 24, 1986

[51] Int. Cl.[4] ..... A43D 11/00

[52] U.S. Cl. ..... 12/54.3; 12/54.1

[58] Field of Search ..... 12/54.1, 54.2, 54.3, 12/8.1

[56] References Cited

U.S. PATENT DOCUMENTS

| | | | |
|---|---|---|---|
| 1,108,100 | 8/1914 | Brock | 12/14.4 |
| 1,108,101 | 8/1914 | Brock | 12/14.4 |
| 1,884,660 | 10/1932 | Gouldbourn | 12/54.3 |
| 2,028,167 | 1/1936 | Pym | 12/14.1 |
| 2,211,042 | 8/1940 | Altvater | 12/51 |
| 2,292,930 | 8/1942 | Daniels | 12/51 |
| 2,329,695 | 9/1943 | Casavant et al. | 12/14.1 |
| 2,357,596 | 9/1944 | MacDonald | 12/51 |
| 2,406,738 | 9/1946 | Brophy | 12/51 |
| 2,656,554 | 10/1953 | Altvater | 12/51 |
| 2,740,976 | 4/1953 | Freeman et al. | 12/51 |
| 2,983,934 | 5/1961 | Bertrand | 12/54.3 |
| 2,986,753 | 6/1961 | Gilbride | 12/8.2 |
| 3,007,182 | 11/1961 | Lauretti | 12/53.5 |
| 3,017,645 | 1/1962 | Herlihy | 12/54.3 |
| 3,096,531 | 7/1963 | Rockwell, Jr. | 12/10.2 |
| 3,138,810 | 6/1964 | Becker | 12/12.3 |
| 3,325,840 | 6/1967 | Barton et al. | 12/54.3 |
| 3,345,661 | 10/1967 | Wilisch | 12/54.3 |
| 3,372,414 | 3/1968 | Arsenawt | 12/8.2 |
| 3,409,921 | 11/1968 | Stew et al. | 12/12.5 |
| 3,442,476 | 1/1969 | Becka | 12/14.5 |
| 3,464,073 | 9/1969 | Brophy | 12/54.3 |
| 3,477,078 | 11/1969 | Andrews et al. | 12/14.4 |
| 3,606,625 | 9/1971 | Ioannilli | 12/14.4 |
| 3,689,952 | 9/1972 | Dawson et al. | 12/14.4 |
| 3,977,033 | 8/1976 | Tabroff | 12/54.3 |
| 4,068,336 | 1/1978 | Becka | 12/14.4 |
| 4,224,708 | 9/1980 | Becka | 12/8.2 |
| 4,246,673 | 1/1981 | Fichtner | 12/14.4 |
| 4,338,696 | 7/1982 | Bichet | 12/54.3 |
| 4,490,868 | 1/1985 | Becka | 12/14.4 |
| 4,508,956 | 4/1985 | Prichard | 219/215 |
| 4,508,965 | 4/1985 | Prichard | 12/54.1 |
| 4,521,176 | 6/1985 | Bouziams et al. | 12/54.3 |

FOREIGN PATENT DOCUMENTS

| | | | |
|---|---|---|---|
| 359195 | 9/1922 | Fed. Rep. of Germany . | |
| 2113408 | 10/1971 | Fed. Rep. of Germany . | |
| 2464662 | 4/1981 | France | 12/54.3 |
| 1296376 | 11/1972 | United Kingdom . | |
| 1327768 | 8/1973 | United Kingdom | 12/54.3 |
| 1355965 | 6/1974 | United Kingdom . | |

OTHER PUBLICATIONS

"Heel Molder Flangers" bulletin, International Shoe Machine.

"Activator Model D" bulletin, International Shoe Machine.

*Primary Examiner*—Werner H. Schroeder
*Assistant Examiner*—Steven N. Meyers
*Attorney, Agent, or Firm*—Robert Shaw

[57] ABSTRACT

An activator for shaping the heel portion of a footwear upper to provide an upper whose heel is shaped approximately to the shape it will ultimately take in the fabricated shoe or other footwear. The activator includes a mold to receive the upper; the mold has a back portion contoured to the required shape of the heel portion of the upper. The activator further includes a pad having a bight region and legs extending from the bight region, which pad has an inner contour that approximately matches the outer contour of the back and adjacent portions of the mold and both can be replaced to fit requirements. The pad has an open position to receive the mold with the upper thereon and a closed position to squeeze the upper between the pad and the mold. A mold drive mechanism is provided to move the mold from a location spaced from the pad to receive the upper to a nested location within the bight region and the legs of the pad. Then the pad is moved around and about the upper and heat is introduced to the upper. Typically, prior to moving the upper into the nested location it is stretched by a longitudinal drawing force. According to the present teaching the angle of draw can be modified to introduce a lateral or transverse component to the direction of draw.

8 Claims, 16 Drawing Figures

ACTIVATOR

The present invention relates to activators that are used in the shaping of the heel portion of a shoe or other footwear upper.

In the specification, emphasis is placed on operations in shoe uppers, but the invention applies to footwear more generally.

A bulletin entitled "Heel Molder Flangers" discloses prior art with respect to the invention herein disclosed. In the bulletin there is shown a heel molder flanger, but also shown are two activators, one at each side of the heel molder flanger which is a two-station machine; that is, it accommodates two shoe uppers. Typically a shoe upper is introduced to an activator which serves to heat the heel region of the upper, which heel region includes a thermal-activated material—that is a material that becomes flexible when heated above some threshold and becomes relatively rigid below that threshold; it is rigid at and below room temperature. The activator is employed to heat the heel region of the upper and to form the heel region to its ultimate shape in the finished shoe. (See bulletin entitled "Activator Model D".) Then the upper is introduced to the heel molder flanger (or other machine) for additional operations. The remainder of this specification is devoted to the activator and its operation. Both bulletins noted above are part of the file history hereof.

It is an objective of the present invention to provide an activator with easy installation of an upper thereon.

Another objective is to provide an activator that permits accurate formation of the heel portion of the upper to the desired shape.

These and still further objectives are addressed hereinafter.

The foregoing objectives are attained, generally, in an activator for shaping the heel portion of a footwear upper, which activator includes a mold which is contoured to the ultimate shape of the heel portion of the upper to receive said upper; a pad having a bight region and legs extending from the bight region, the pad having an inner contour that matches the contour of the mold, which pad has an open position and a closed position; a pad drive mechanism to move the pad from the open position to the closed position respectively to receive the mold with the upper thereon and to press the upper between the mold and the pad; a mold drive mechanism to move the mold, as alternate conditions of activator operation, from a location spaced from the pad to permit the upper to be placed onto the mold to a nested location between the legs of the pad; pincers (or grippers) positioned to receive the toe end of the upper and operable to grasp the toe end; a pincers drive mechanism operable to move the pincers longitudinally to draw the upper about the mold to stretch the heel portion of the upper to the approximate contour of the mold at the back portion of the mold; the mold drive mechanism being adapted, once the upper is stretched about the mold, to move the mold with the upper stretched thereupon from spaced location to the nested location; the pad drive mechanism thereafter serving to close the pad about the mold to shape the heel of the upper to the contour of the mold; and an energy source to heat the mold and pad, thereby to heat the heel portion of the upper (including the upper material and the counter) and cause the heel portion to conform even more closely to the shape of the back portion of the mold, the mold drive mechanism thereafter acting to move the mold and formed upper to the spaced location.

The invention hereinafter described with reference to the accompanying drawing in which.

Figure 1:
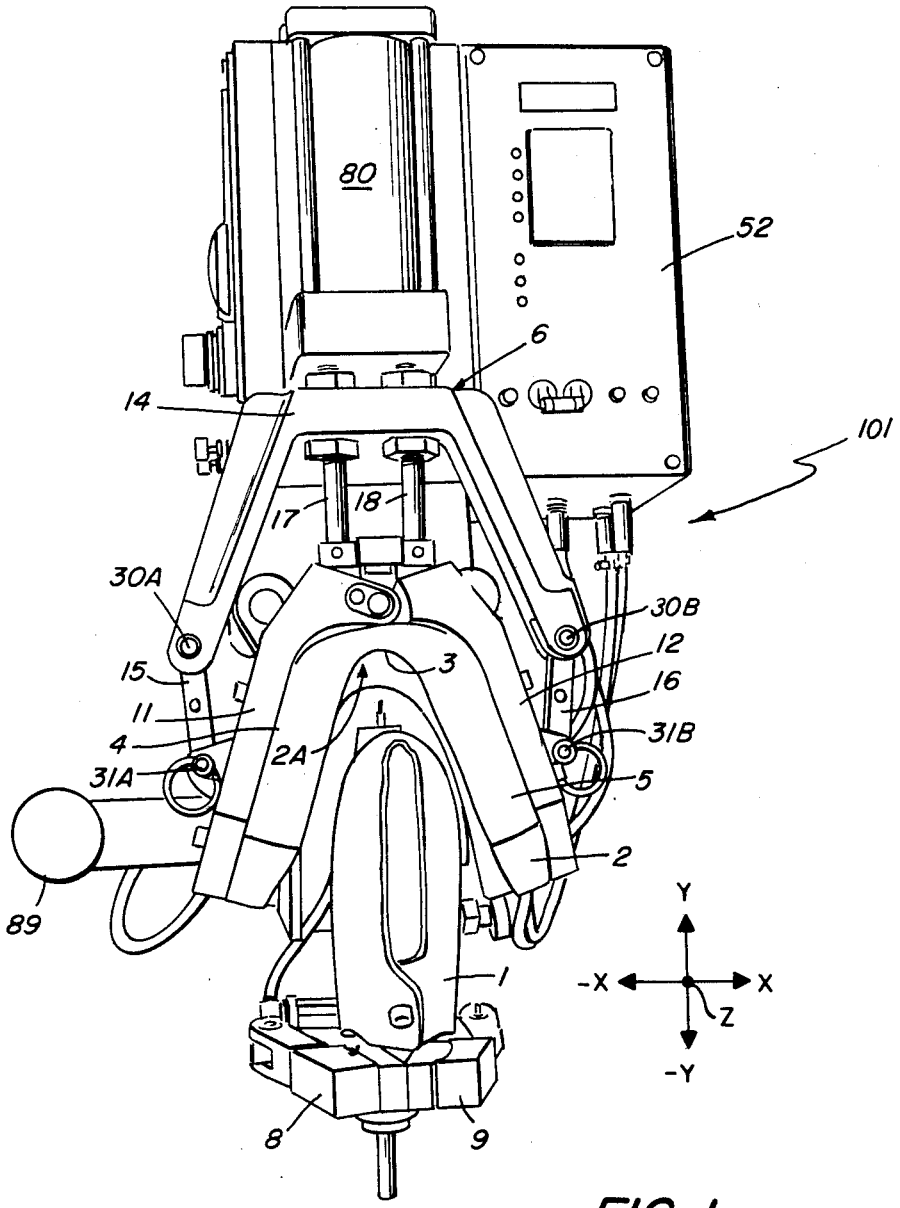
FIG. 1 is a front view of an activator according to the present teachings, and showing, among other things, a mold, pincers and a pad adapted to wrap around the mold.
Figure 15:
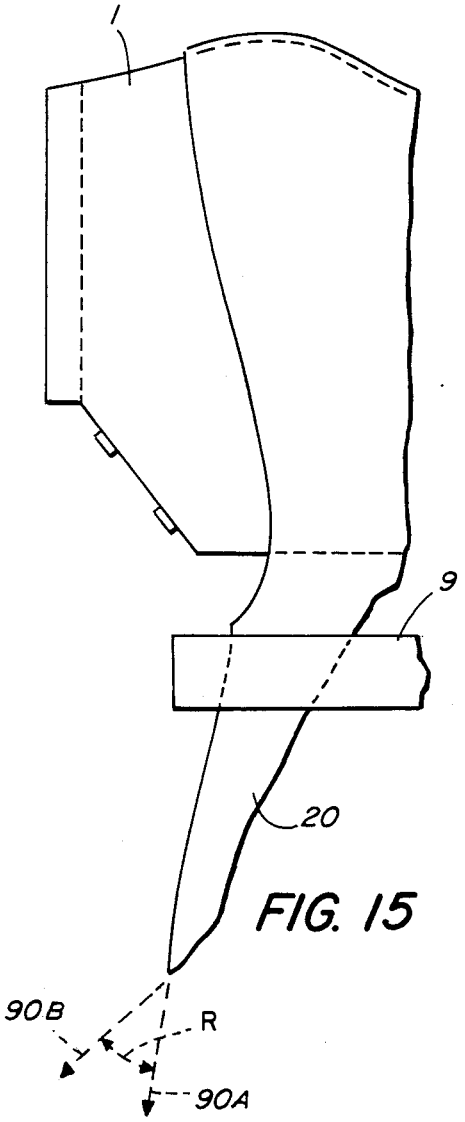
FIG. 15 is a side view of a mold with an upper thereon.
Figure 16:
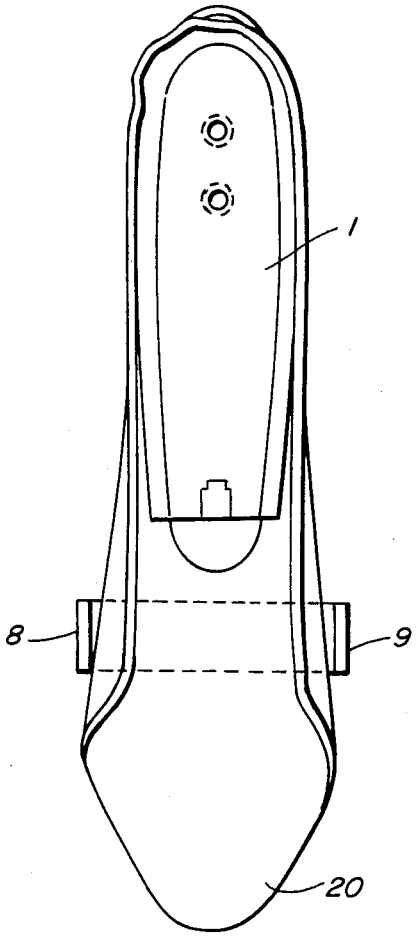
FIG. 16 is a plan view of the mold and upper in FIG. 15.

Turning now to FIG. 1, there is shown at 101 an activator for heating the heel portion of a footwear upper. An upper 20 (see FIG. 5) is received by a mold 1. The back portion or surface of the mold 1 is curvilinear and is contoured approximately to the ultimate shape of the heel portion of the upper; see FIGS. 15 and 16 which show the mold 1 with an upper 20 thereon.

In FIG. 1 and the other figures the machine operator is intended to stand facing the machine 101 (i.e., looking in the minus Z-direction in FIG. 1). Machine parts closed to the operator are considered to be at the front of the machine 101 and machine parts furthest from the operator are considered to be at the back of the machine. Parts moving toward the operator are considered to have forward movement and parts moving away from the operator are considered to have rearward movement.

The function of the machine 101 is to heat the heel portion of the upper to render it malleable and shaped; then the upper is introduced to another machine where it is quickly cooled and formed to its ultimate shape. As this explanation progress, it will be seen that the machine 101 not only heats the heel region of the upper, it also initially forms that heel region toward its ultimate shape or contour. The machine 101 includes a pad 2

Figure 2:
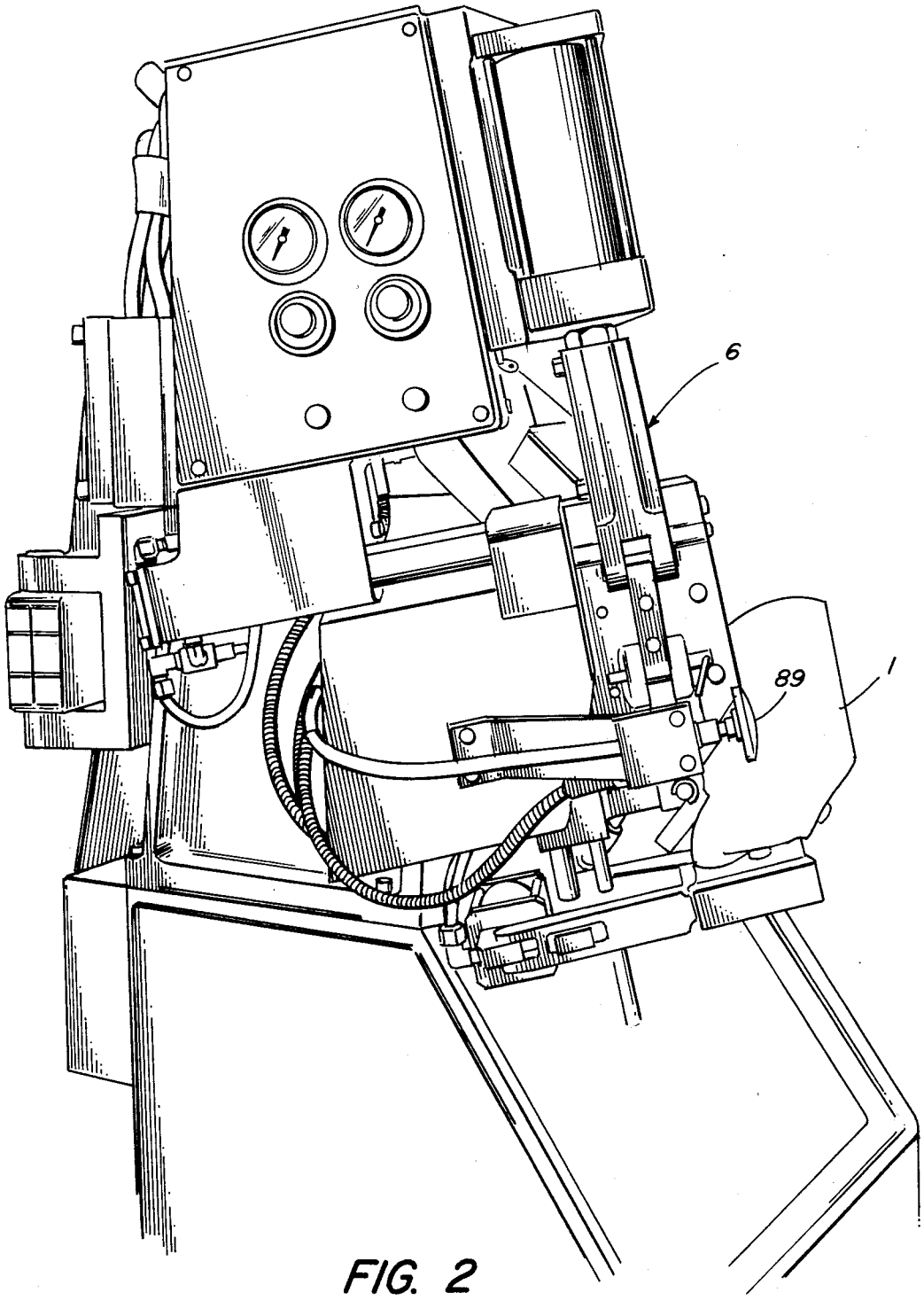
FIG. 2 is a left side view of the activator of FIG. 1 showing the mold spaced forward of the other portions of the activator.
Figure 3:
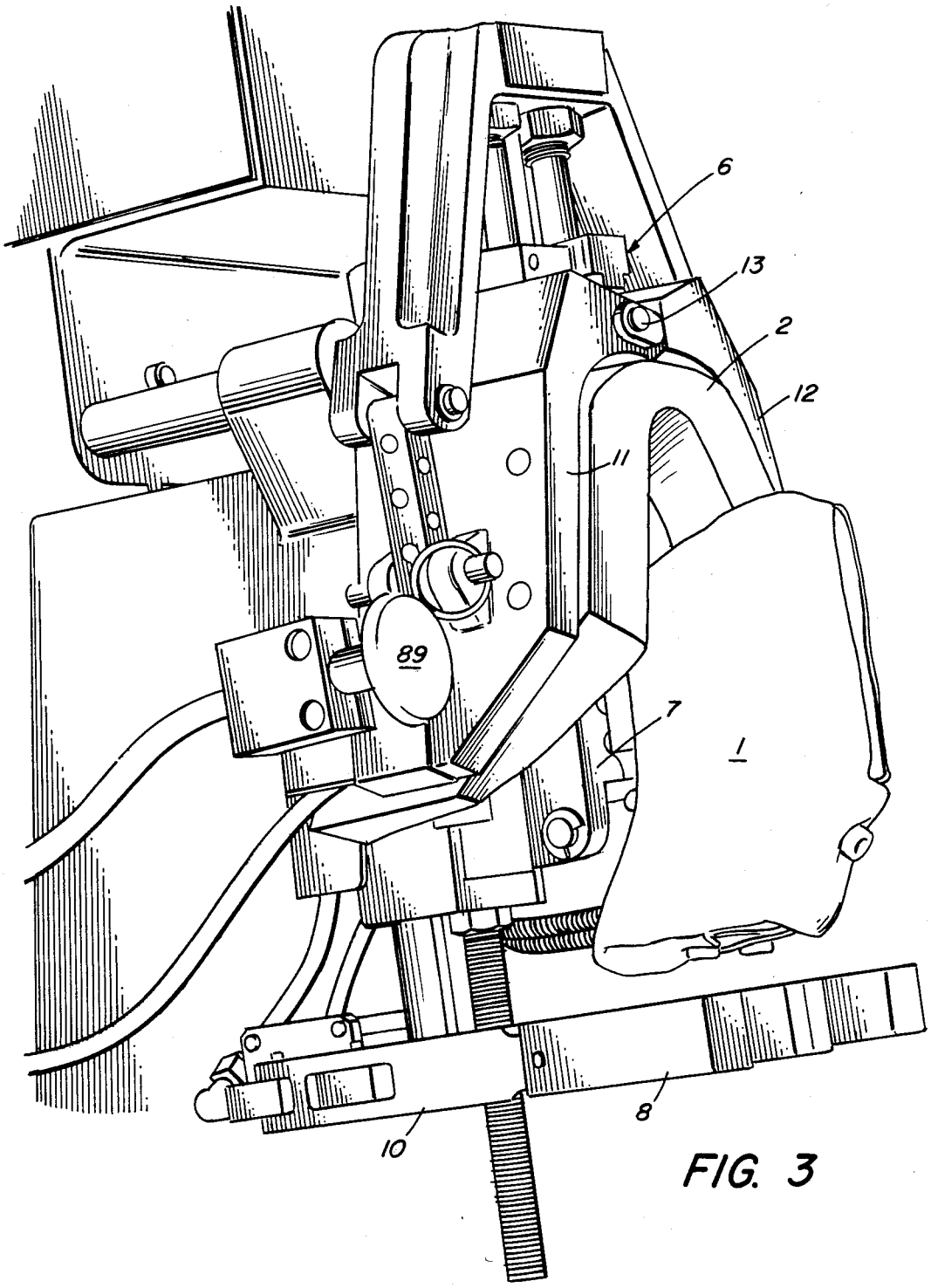
FIG. 3 is a left isometric view, again showing the mold spaced forward.
Figure 4:
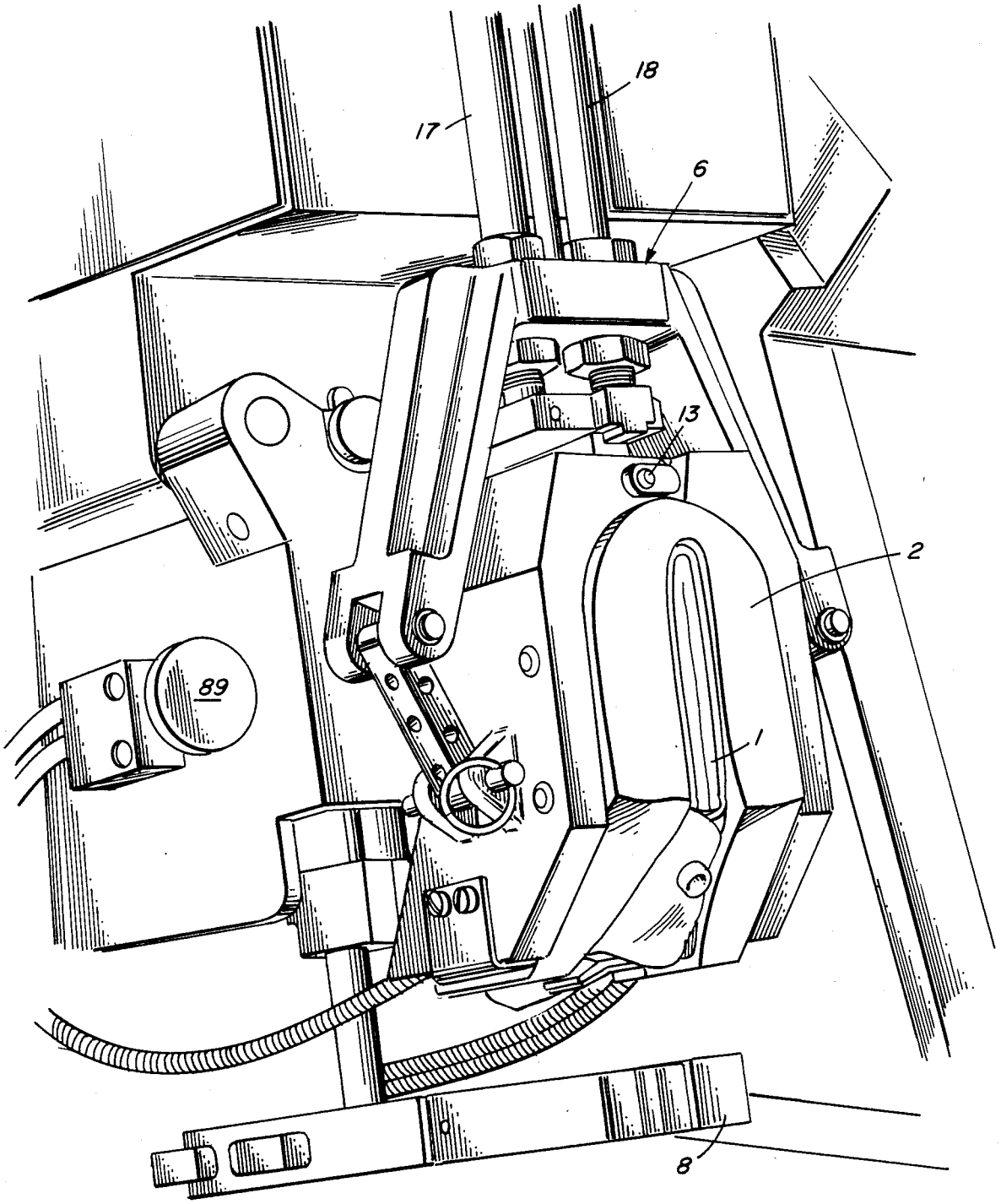
FIG. 4 is a view similar to FIG. 3 except that the mold is in a retracted or nested position with respect to the pad and the pad is closed upon the mold.
Figure 5:
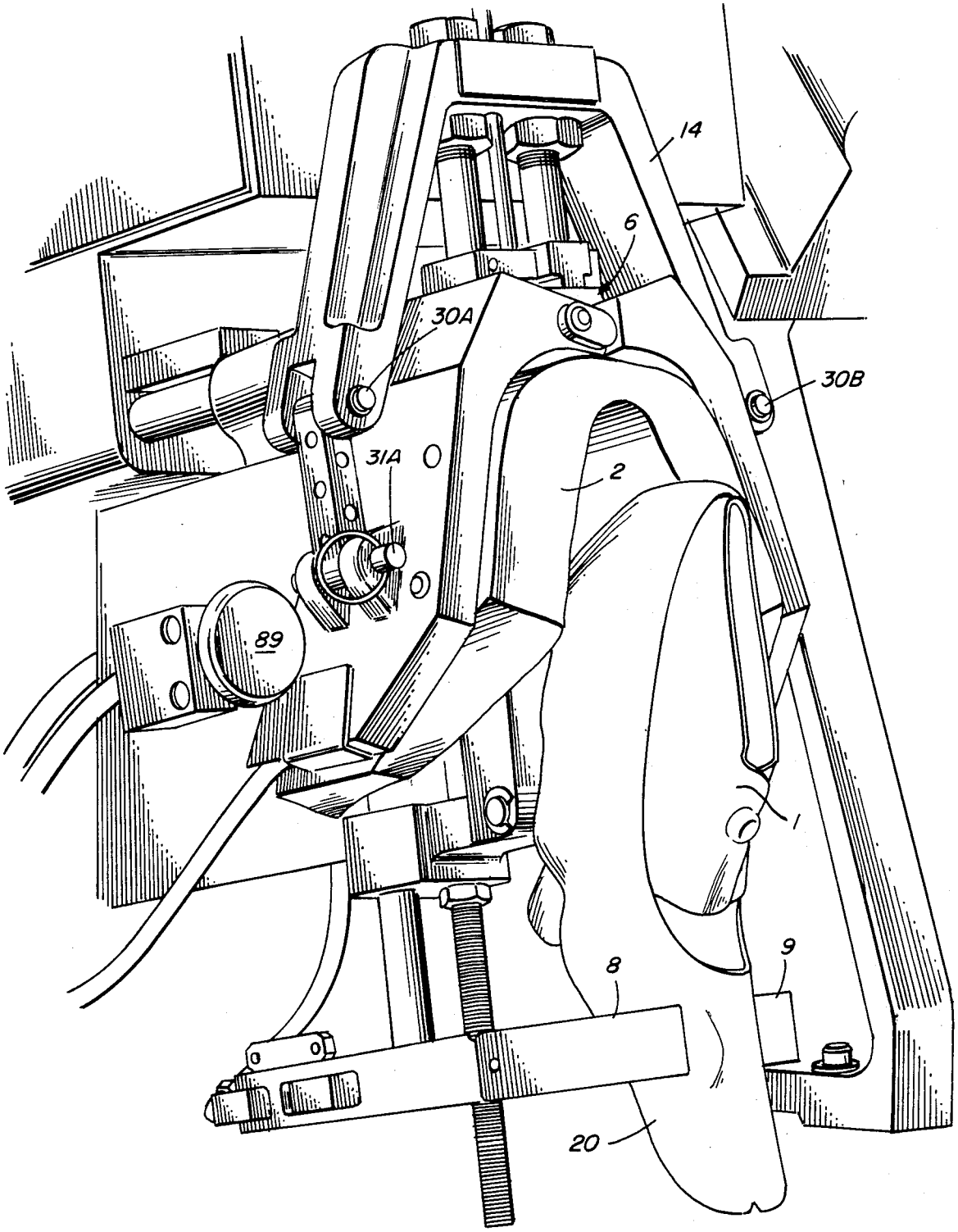
FIG. 5 is a view like FIG. 3 except that a footwear upper is shown upon the mold.
Figure 6:
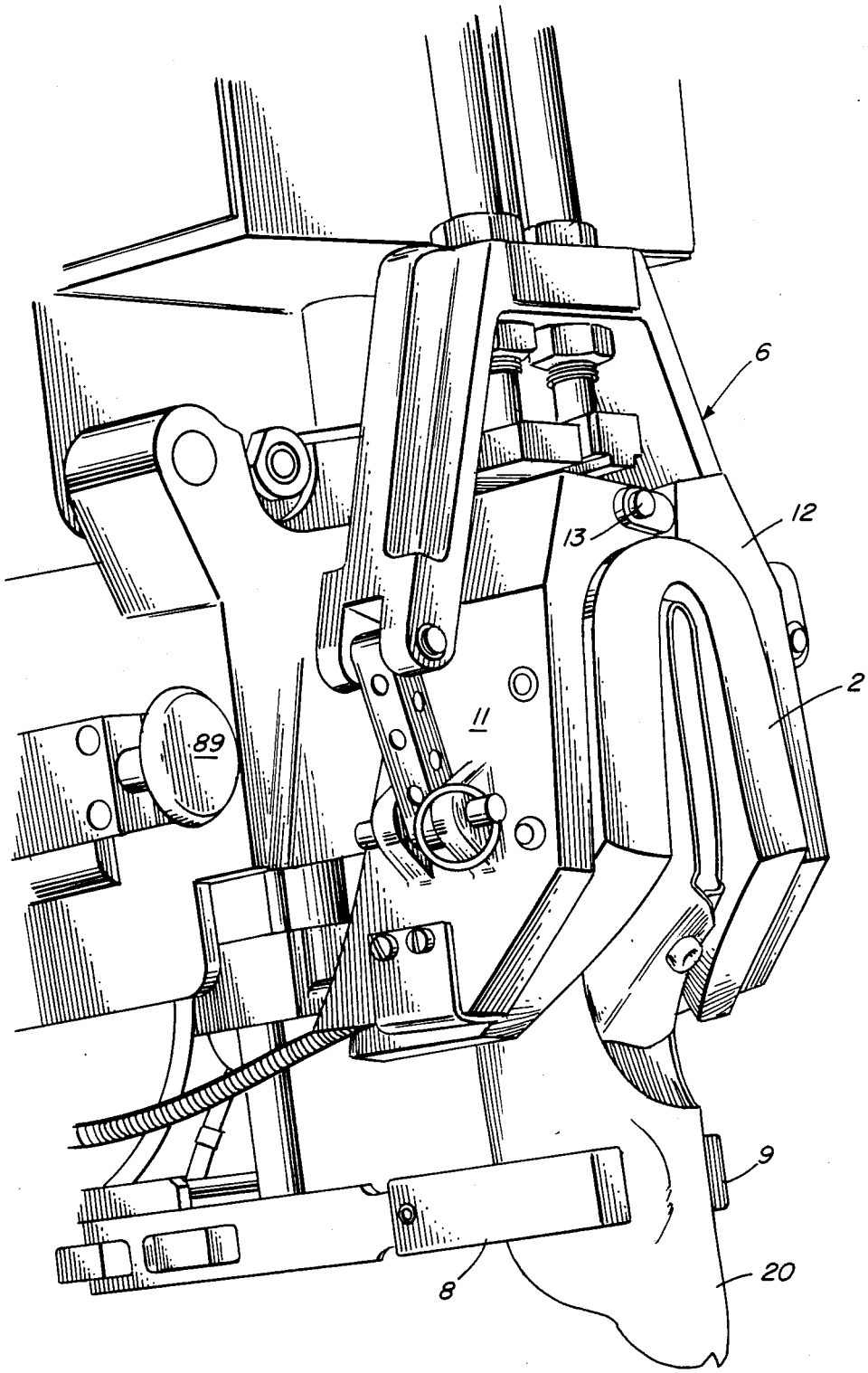
FIG. 6 shows the upper of FIG. 5 stretched by the pincers and nested within the pad with the pad closed thereupon.
Figure 7:
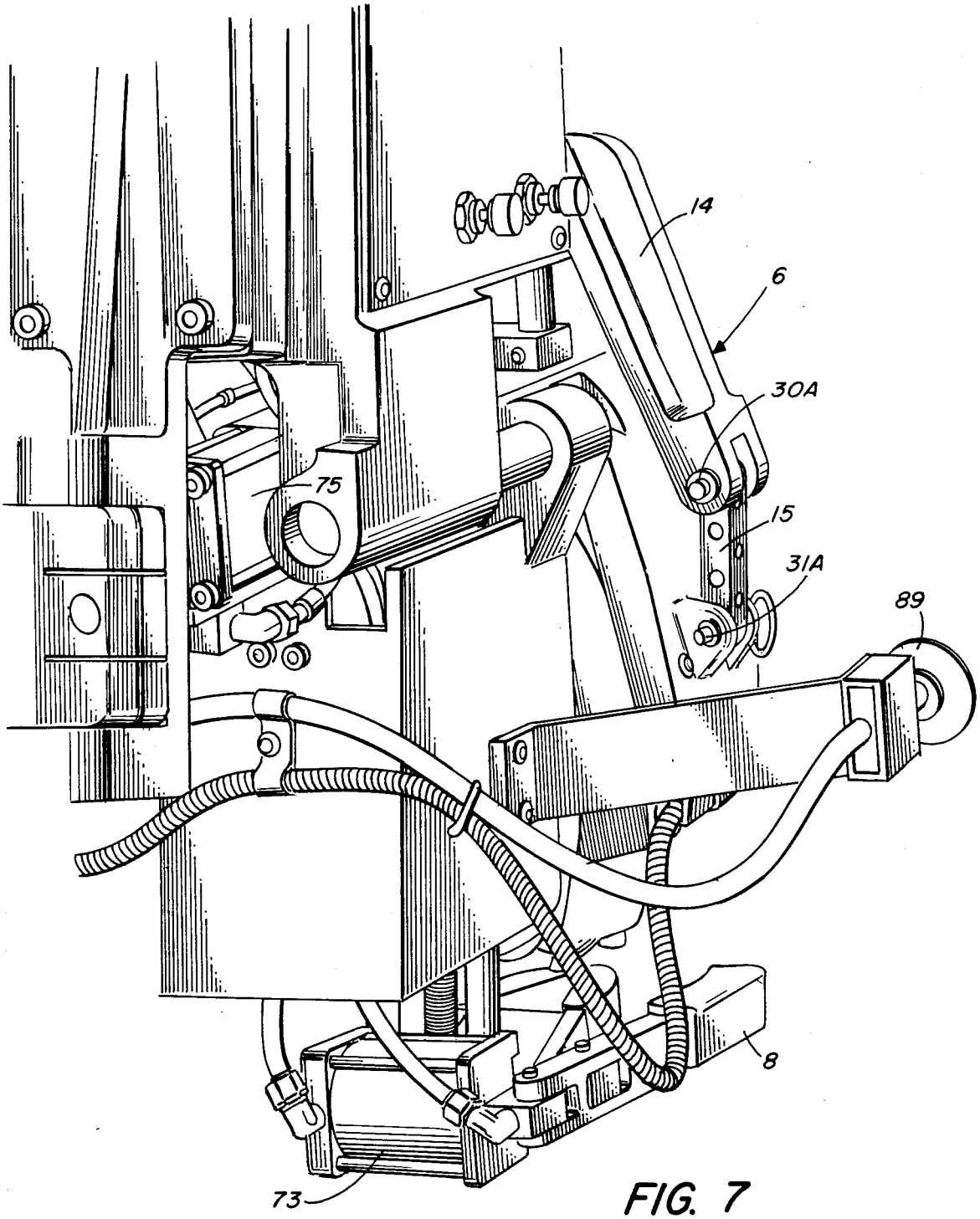
FIG. 7 is an isometric view taken from the right, rear of the machine of FIG. 1.

(e.g., Silicone) having a bight region 3 and legs 4 and 5 extending from the bight region; the pad 2 has an interior contour generally marked 2A in FIG. 1 (at the side facing the mold 1) that closely matches the contour of the mold 1. The pad 2 has an open position, shown in FIGS. 1, 3 and 5 and a closed position shown in FIGS. 4 and 6. A pad drive mechanism 6, FIG. 2, as explained below, moves the pad 2 from the open position to the closed position respectively to receive the mold with the upper 20 thereon and to press the upper between the mold and the pad 2. A mold drive mechanism 7 in FIG. 3, discussed later, moves the mold 1, as alternate conditions of activator operation, from a location spaced forward from the pad, as shown in FIG. 3, to permit the upper 20, FIG. 5, to be placed onto the mold to a nested location, FIG. 6, between the legs of the pad. Pincers (or grippers) 8 and 9 are positioned to receive the toe end of the upper 20 and are operable to grasp the toe end as shown in FIGS. 5 and 6.

A pincers drive mechanism 19 in FIG. 8, discussed later, is operable to move the pincers longitudinally downward in FIGS. 6 and 8 to draw the upper 20 about the mold 1 thereby to stretch the heel portion of the upper to the contour of the back of the mold. The pincers drive mechanism 19 operates to move the pincers longitudinally in a straight line motion. The direction of draw can be modified to cause the heel portion of the upper to conform closely to the curvilinear back region of the mold 1. The mold drive mechanism 7 is adapted, once the upper is stretched about the mold, to move the mold, with the upper stretched thereon, from the spaced (outward) location in FIG. 5 to the nested location in FIG. 6. The pad drive mechanism 6 thereafter serves to close the pad 2 about the upper 20 to the contour of the mold, as shown in FIG. 6. A time and temperature control unit 52 in FIGS. 1 and 10 serves as an energy source that energizes heaters 54 and 55 (FIG. 10) within the mold and the pad 2, respectively; heat from the mold and pad passes to the upper 20 which is pressed therebetween, thereby heating the heel portion of the upper which becomes even more flexible and pliable, thereby to conform even more closely to the shape of the mold 1. The pad drive mechanism 6, after a time interval, acts to open the pad 2. Also, through delay elements 100 and 89 in FIG. 11, the mold drive mechanism 7 acts to move the mold and the formed upper to the spaced location whence the upper can be easily removed from the mold to permit other operations to be performed thereon. Some of the structures referred to aboveare now addressed in some detail. It should be noted that some of the activator parts referred to below are physically located within the activator 101 but are shown diagrammatically in FIG. 10.

The pad drive mechanism 6 in FIG. 3 includes two pad support halves or arms 11 and 12 which are joined at a pivot point 13. The pad support halves 11 and 12 are pivoted about the point 13 by a linkage that includes a yoke 14 and links 15 and 16. The rods marked 17 and 18 in FIG. 1 drive the yoke 14 down and up and, in turn, are driven by a double-acting air cylinder 80. Pivoting between the links 15 and 16 and the yoke 14 occurs at 30A and 30B, respectively; pivoting between the links 15 and 16 and the pad support halves 11 and 12 occurs at 31A and 31B. The pad 2 is mechanically connected to the pad support halves 11 and 12.

Figure 10:
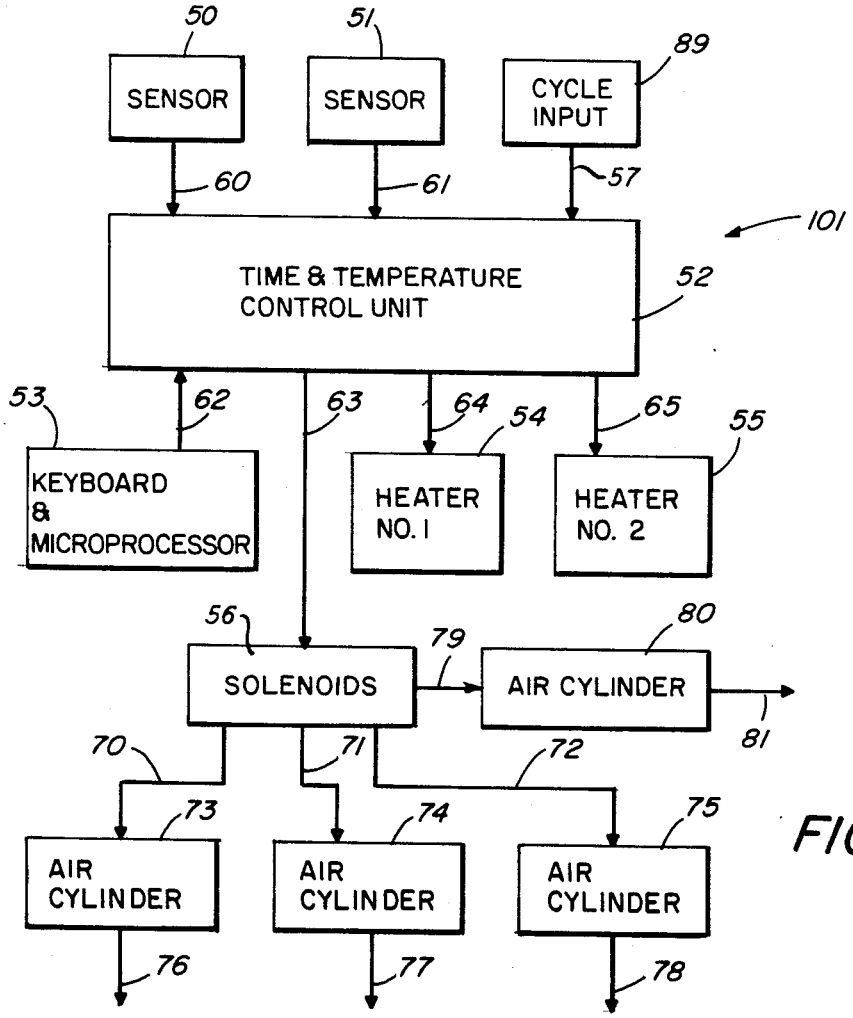
FIG. 10 is a block diagram mostly of electrical circuitry in the activator of FIG. 1.

The air cylinders labeled 73, 74, 75 and 80 in FIG. 10 are double acting air cylinders that respectively serve to open and close the pincers 8 and 9, to stretch the upper 20 about the mold 1, to move the mold 1 forward to the spaced position and back to the retracted or nested, position, and to move the pad 2 from its open position to its closed position.

Figure 8:
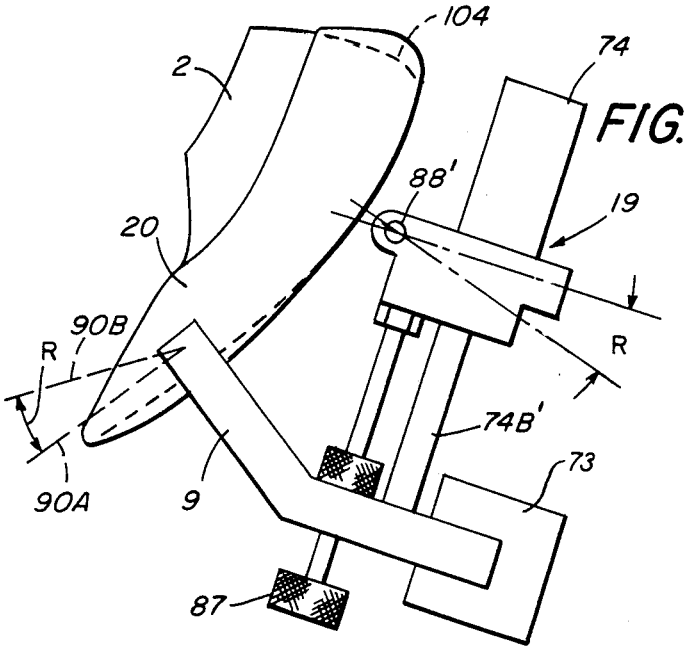
FIG. 8 is a side view to show a mechanism to change the direction of draw of the pincers in FIG. 1.
Figure 12:
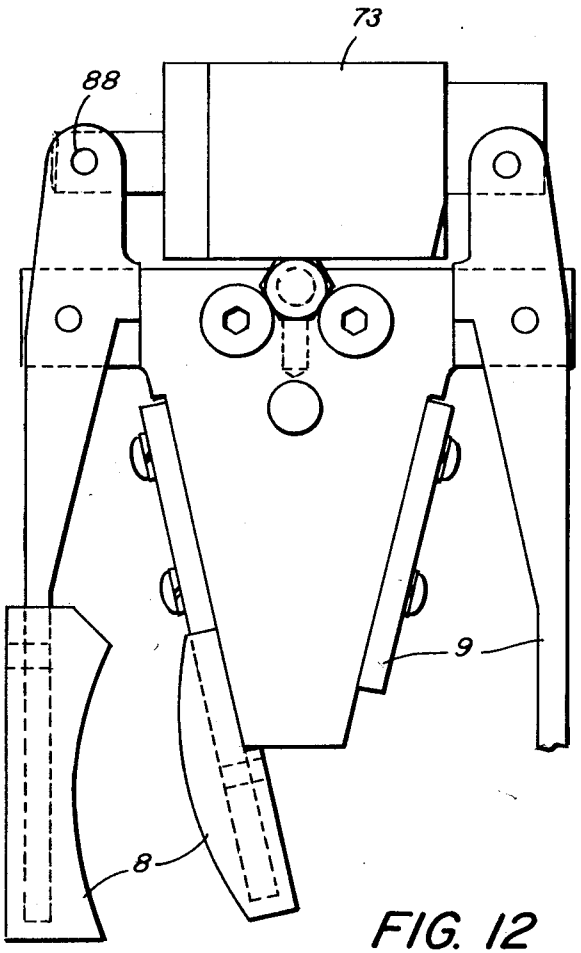
FIG. 12 is a plan view showing the pincers in FIG. 1 and closely-related parts.

The pincers drive mechanism 19 in FIG. 8 is adjustable in that the direction of draw of the pincers 8 and 9 can be adjusted to effect control of the draw angle, as now explained with reference to FIGS. 12, 13 and 14. The draw angle of the pincers 8 and 9 can be changed from the direction labeled 90A in FIG. 15 through a wide angle R to the direction labeled 90B. In accordance with the present specification the direction 90A is longitudinal draw, whereas the direction 90B includes a longitudinal component as well as a lateral or transverse component. According to the present invention, the direction of draw can be modified to change the angle R.

Figure 13:
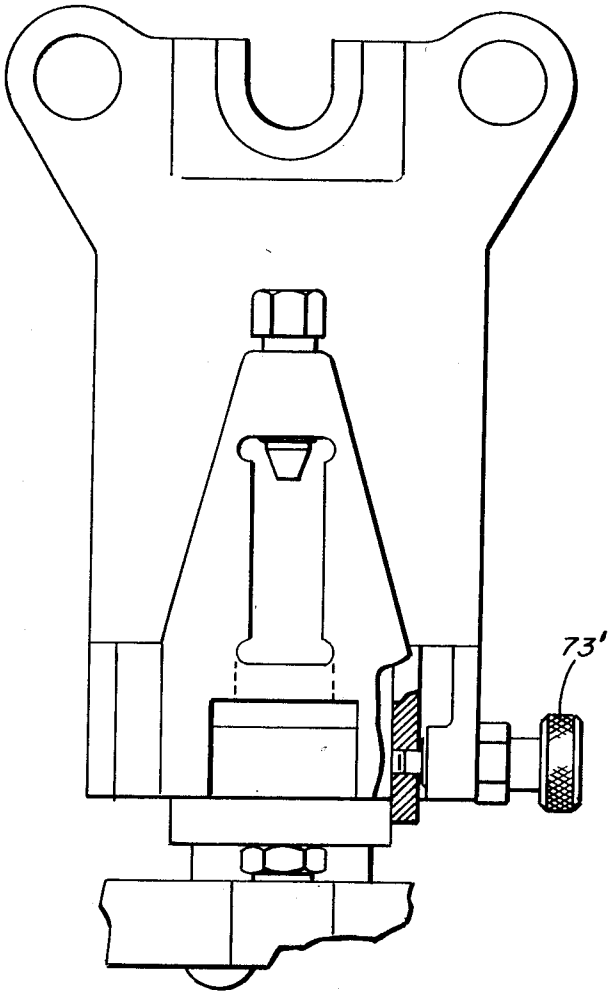
FIG. 13 is a plan view of a portion of the pincers and other closely-related parts, in part to show a mechanism to permit changes in the angle of draw of the pincers.
Figure 14:
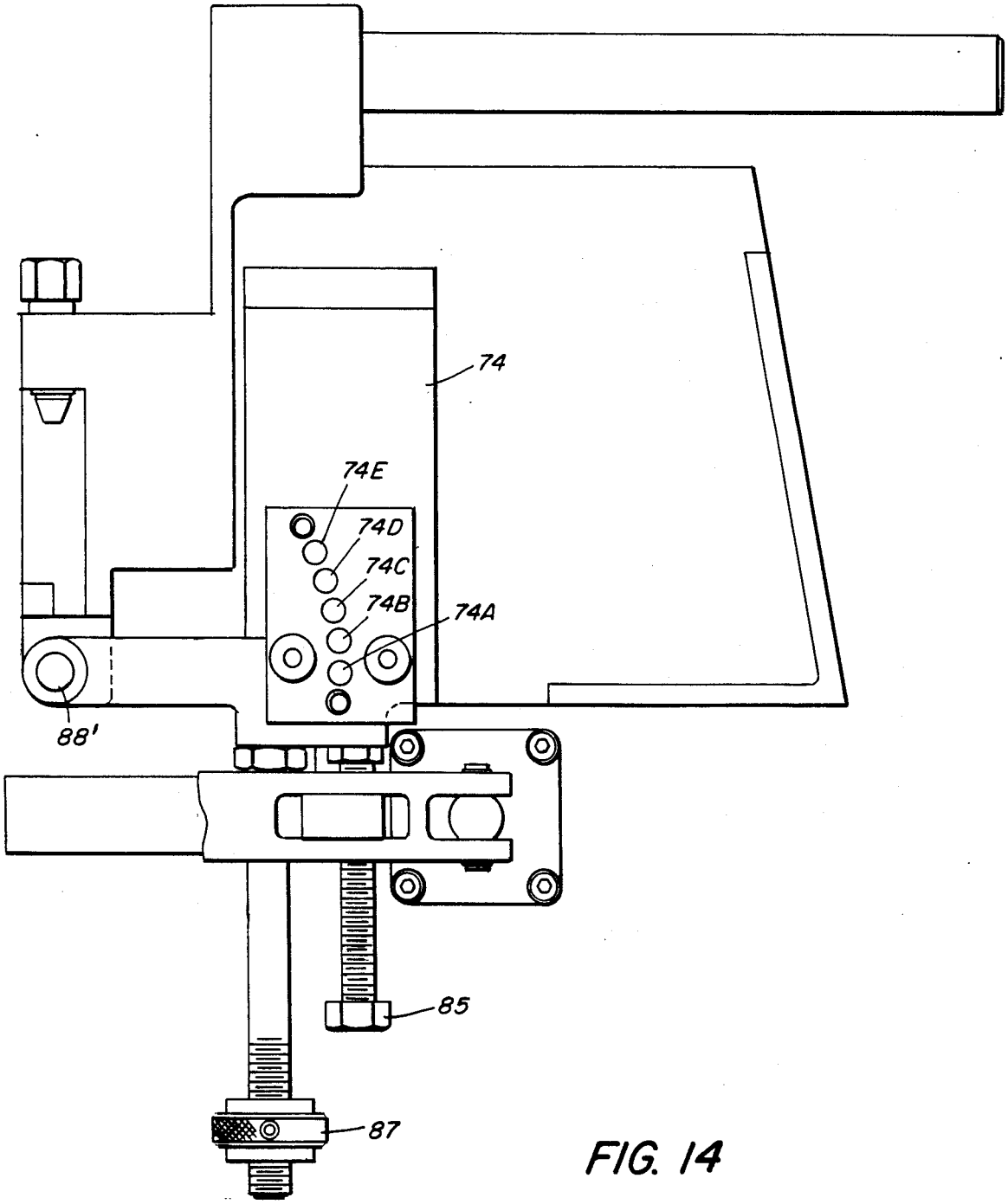
FIG. 14 is a side view of the pincers, a stretch cylinder, and a mechanism to permit changes in the angle of draw.

The angle of draw is modified by changing the setting hole 74A . . . 74E in FIG. 14 in which the angle adjuster designated 73' in FIG. 13 is inserted. Pivoting is effected thereby about a pivot 88' in FIGS. 8 and 14 to establish the particular direction of draw of the pincers 8 and 9. The length of draw is determined by the location of a stop nut 87, FIGS. 8 and 14. It will be understood that the upper 20 will differ in length depending upon shoe size. While the distance an upper is drawn is established by the nut 87, the initial position of draw for any particular upper is established by the position of a stop screw 85 in FIG. 14. Stretch of the upper is effected by a stretch cylinder 74. The direction of draw, FIG. 5, is controlled by the position of the angle adjuster 73' in FIG. 13 in the holes 74A–74E in FIG. 14, as previously indicated.

The block diagram in FIG. 10 is a combination of electrical apparatus and mechanical apparatus to perform certain functions. One such function performed is a heating function whereby the upper 20 is elevated in temperature at the heel region to render it malleable; another function is stretching the upper 20; and so forth. Briefly, the time, temperature and control unit 52 on receiving a cycle input signal at 57 from a push button 89 initiates a cycle of operation. The control of the unit 52 is achieved by a keyboard and microprocessor 53 which includes a microprocessor (e.g., RF300-01 marketed by Thermologic). Inputs to the unit 52 are temperature inputs 60 and 61 from sensors 50 and 51, respectively; the unit 52, among other things, controls heaters 54 and 55 that introduce heat energy to the mold 1 and the pad 2 respectively. The unit 52 also controls a plurality solenoids 56 which along mechanical connections 70, 71, 72 and 79 control air cylinders 73, 74, 75 and 80, respectively, whose outputs 76, 77, 78 and 81, respectively, are mechanical connections; see FIG. 11 with respect to the various structures noted. The double acting air cylinder 73 acts to open and close the pincers; the double-acting air cylinder 74 serves to stretch the upper 20 by use of the pincers, the air cylinder 75 moves the mold 1 forward and aft respectively to a spaced position and a nested position, and the air cylinder 80 serves to move the pad 2 from its open position to its closed position about the mold 1. The labels 62, 63, 64 and 65 designate electrical signals respectively from the unit 53 to the unit 52, inputs to the solenoids 56 from the unit 52, and electrical power inputs to the heaters 54 and 55 from the unit 52.

Figure 11:
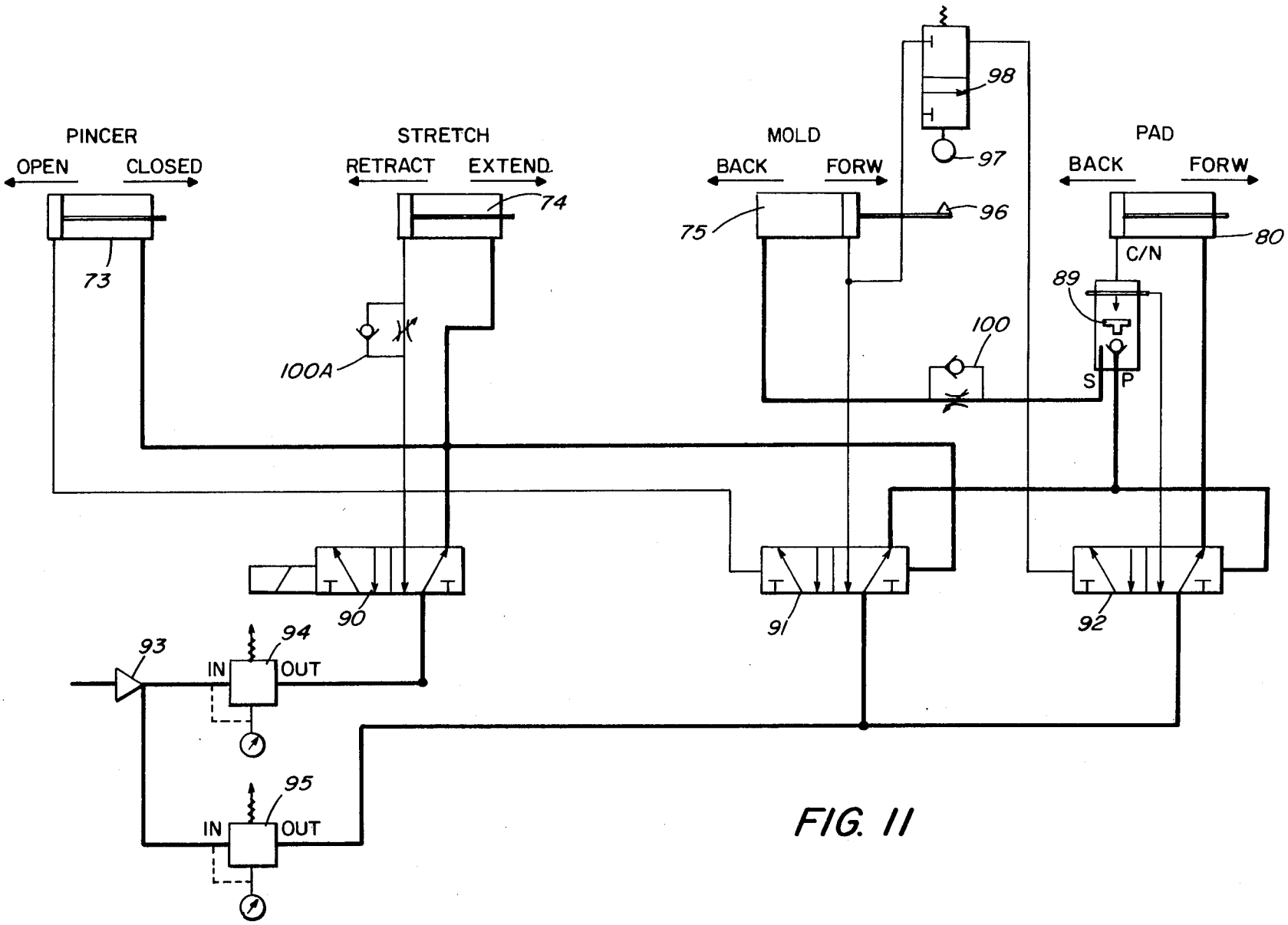
FIG. 11 is an air diagram for the activator of FIG. 1.

The functions just discussed on reference to FIG. 10 apply also to FIG. 11 which includes the double-acting cylinders 73, 74, 75 and 80 but includes also four-way double-acting valves 90, 91 and 92. The designation 93 indicates air input to the system; 94 and 95 indicate air pressure regulators. The unit 90 indicates a four-way solenoid/spring return valve. The units 91 and 92 are four-way double-pilot valves; units 94 and 95 are air pressure regulators to control input air pressure to valves 90, 91, 92; a valve 98 is controlled by a cam 96 which is moved left and right in FIG. 11 by the air cylinder 75 to actuate a valve stem 97. The system is cycled by a push bottom 89 (see FIG. 10). The label 100A represents a flow control valve. A brief discussion of machine cycling follows.

To review a cycle of the machine 101, an operator places an upper on the mold 1 and pushes the button 89 which is an electrical start switch. The pincers 8 and 9 close upon the upper 20 and stretch it as before discussed. The mold 1, which has been spaced from the pad 2, is moved into and within the bight region 3 of the pad 2. The pad 2 is moved down and around the upper 20 by the air cylinder 80 through shafts 17 and 18 and the linkages that move the pad supports 11 and 12. A timer in the unit 52 establishes the length of time that the pad 2 is enclosed about the upper 20 on the mold 1, thereby to establish the amount of heat energy introduced and hence the temperature of the heel region of the upper 20. The pincers 8 and 9 then open and retract; the pad 2 is opened and retracted; the mold 1 is extended; and the cycle is repeated.

Figure 9:
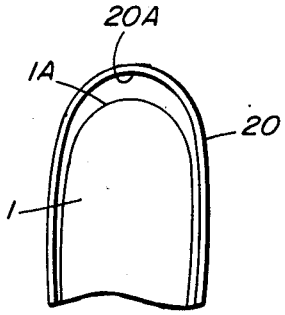
FIG. 9 is a plan view of a portion of the mold with an upper thereon.

Mention is made above to a facet of the machine 101 that permits changes in the direction the pincers draw or pull the upper; that is, downward pull of the upper 20 in FIG. 5 to stretch it about the curvilinear back part labeled 1A in FIG. 9 of the mold 1 by a force executed by the double-acting air cylinder 74 (having a shaft 74B' in FIG. 8), the designation 19 in that figure representing the combined apparatus to effect stretching of the upper 20. The direction of pull is generally downward in FIG. 1, that is, in the minus-Y direction.

The pincers 8 and 9 are positioned to grasp the upper 20 as shown in FIG. 8 and elsewhere, at or just forwardly of the ball portion of the upper 20. The pincers 8 and 9 apply a generally longitudinally-directed force (minus-Y in FIG. 1 and downward in FIG. 8) in tension upon the shoe upper in the direction of the toe portion of the upper to stretch the heel portion 20A about the curvilinear back region 1A of the mold 1. The pincers 8 and 9 are selectively adjustable over a wide angle R from the direction labeled 90A in FIG. 8 to an off-axis force in the direction labeled 90B to permit application of a tensile force adapted to cause the heel portion 20A to conform to the curvilinear back region 1A despite any malformation 104 in FIG. 8 of the heel portion 20A prior to molding. The tensile force on the upper 20 is applied by the pincers 8 and 9 which are driven by the air cylinder 74, as before discussed. The whole pincers mechanism pivots at 88' through the wide angle R, as before noted.

Modifications of the invention will occur to persons skilled in the art and all such modifications are deemed to be within the scope of the invention as defined by the appended claims.

What is claimed is:

1. An activator for shaping the heel portion of a footwear upper that comprises:

a mold contoured to the ultimate shape of the heel portion of the upper to receive said upper;

a pad having a bight region and legs extending from the bight region, said pad having a contour that matches the contour of the mold with the upper placed thereon, which pad has an open position and a closed position;

pad drive means to move the pad from the open position to the closed position respectively to receive the mold with the upper thereon and to press the upper between the mold and the pad;

mold drive means to move the mold, as alternate conditions of activator operation, from a location spaced from the pad to permit the upper to be placed onto the mold to a nested location between the legs of the pad;

pincers positioned to receive the forepart of the upper and operable to grasp said toe end;

pincers drive means operable to move the pincers longitudinally to draw the upper about the mold to stretch the heel portion thereof to the contour of the mold;

the mold drive means being adapted, once the upper is stretched about the mold, to move the mold with upper stretched thereupon from the spaced location to said nested location;

said pad drive means thereafter serving to close the pad about the mold to shape the heel of the upper to the contour of the mold; and means to heat the mold and pad thereby to heat the heel portion of the upper and cause said heel portion to conform even more closely to the shape of the mold, the drive means thereafter acting to move the mold and formed upper to said spaced location.

2. An activator according to claim 1 in which the pincers drive means is adjustable in that the direction of draw of the pincers can be adjusted to effect control of the draw angle.

3. An activator according to claim 2 in which the direction of draw is adjustable through a wide angle to control the integrity of the molded heel.

4. An activator according to claim 1 in which the means to heat includes heaters to heat both the mold and the pad.

5. An activator according to claim 1 in which the pad drive means comprises a pivot structure having two sides joined at a pivot point, which sides pivot about the pivot point, a linkage being provided to connect a drive cylinder to the sides to effect pivoting, whereby the pad can be moved by said sides from the open position to the closed position as alternate positions during operation of the activator.

6. An activator for shaping the heel portion of a footwear upper that comprises:

a mold whose back portion is contoured to the required shape of the heel portion of the upper, to receive the upper;

a pad having a bight region and legs extending from the bight region, said pad having an inner contour that approximately matches the contour of the mold, which pad has an open position and a closed position;

mold drive means adapted to move the mold from a location spaced from the pad to receive the upper and thereafter to a nested location within the bight region and between the legs of the pad;

drive means that is operable to move the pad from the open position, once the mold with the upper thereon is in said nested location, to said closed position; and means to heat the heel region of the upper when it is pressed between the pad and the mold.

7. An activator for shaping the heel portion of a footwear upper that comprises:

a mold or the like whose back portion is contoured to the required shape of the heel portion of the upper, to receive the upper;

a pad having a bight region and legs extending from the bight region, said pad having an inner contour that approximately matches the contour of the mold, which pad has an open position and a closed position;

pincers positioned to receive the upper at the forepart thereof and operable to grasp the upper; and pincers drive means operable to move the pincers longitudinally, in a straight line motion, to draw the upper about the mold or the like to stretch the heel portion thereof to the contour of the mold or the like, said pincers drive means being adjustable in that the direction of draw can be adjusted to effect control of the draw angle and hence control the integrity of the molded heel portion of the upper to the back portion of the mold or the like.

8. An activator according to claim 7 and in which the direction of draw includes a longitudinal component as well as a lateral or transverse component, the magnitude of the longitudinal component relative to the laterial or transverse component being adjustable relative to one another to effect control of the draw angle through said wide angle R.

* * * * *